US005176533A

United States Patent [19]

Sakurai et al.

[11] Patent Number: 5,176,533

[45] Date of Patent: Jan. 5, 1993

[54] ELECTRICAL CONNECTOR

[75] Inventors: Yuji Sakurai; Mitsuru Takeda, both of Tokyo, Japan

[73] Assignee: Daiichi Denshi Kogyo Kabushiki Kaisha, Japan

[21] Appl. No.: 886,978

[22] Filed: May 21, 1992

[30] Foreign Application Priority Data

May 31, 1991 [JP] Japan ..... 3-049191

[51] Int. Cl.[5] ..... H01R 13/627

[52] U.S. Cl. ..... 439/352; 439/350

[58] Field of Search ..... 439/345, 350, 352, 357, 439/358, 489, 490, 924

[56] References Cited

U.S. PATENT DOCUMENTS

| | | | |
|---|---|---|---|
| 3,745,514 | 7/1973 | Brishka | 439/352 X |
| 3,953,098 | 4/1976 | Auvery et al. | 439/352 X |
| 4,915,642 | 4/1990 | Lin et al. | 439/352 |
| 5,082,455 | 1/1992 | Wei | 439/352 |

*Primary Examiner*—Larry I. Schwartz
*Assistant Examiner*—Khiem Nguyen
*Attorney, Agent, or Firm*—Silverman, Cass & Singer

[57] ABSTRACT

An electrical connector includes a connector receptacle having a contact and a cylindrical socket formed with a radially inwardly extending stopper and axially extending slits, and a connector plug having a contact, a plug body formed in the outer circumference with an anchoring recess to be fitted with the stopper, a coupling arranged on the plug body to be able to retract rearwards, and a slide ring arranged axially movably between the plug body and the coupling and forwardly urged by a spring arranged between the slide ring and the plug body to cover the anchoring recess by the forward end of the slide ring. The distance between the forward ends of the contacts is more than the distance between the forward ends of the stopper and the slide ring but less than the distance between the stopper and the anchoring recess. When the connector plug is inserted into the connector receptacle, the contacts do not electrically contact each other yet at the moment when the stopper has abutted against the forward end of the slide ring, while the contacts electrically contact each other when the stopper has fitted in the anchoring recess to lock the connector receptacle and the connector plug.

5 Claims, 4 Drawing Sheets

ELECTRICAL CONNECTOR

BACKGROUND OF THE INVENTION

This invention relates to a push-on type electrical connector (referred to as "push-on connector" hereinafter).

The applicant of this application proposed a push-on connector disclosed in Japanese Utility Model Application Laid-open No. 63-164,183. The disclosed push-on connector applied to a coaxial connector will be explained by referring to FIG. 3 and FIGS. 4*a*, 4*b* and 4*c*.

As shown in the drawings, a connector plug 20 includes, between a coupling 23 and a plug body 22, a slide ring 24 whose diameter is so determined that its forward end is urged by the stopper 13 provided along the forward end of the socket 12 of a connector receptacle 10. A spring 26 is provided between the slide ring 24 and the plug body 22 to urge the slide ring 24 towards the connector receptacle 10, while the coupling 23 is formed at its forward end with a latch portion 231. The coupling 23 is slidable rearward on the plug body 22 against the force of the spring 26. The forward movement of the coupling 23 is restricted by an abutment of its rear latch portion 232 against one edge of C-shaped spring ring 28.

The term "forward end" used herein is intended to designate the end of a member of the connector plug 20 nearer to the mating connector receptacle 10 or the end of a member of the connector receptacle 10 nearer to the mating connector plug 20 when the connector plug 20 and the connector receptacle 10 are arranged about to be connected to each other as shown in FIG. 3. Whereas the "rear end" means opposite sense.

On the other hand, the slide ring 24 is formed on its outer circumference with an anchoring portion 241 for regulating the position of the slide ring 24 with the aid of the latch portion 231 of the coupling 23. As a result, the slide ring 24 is always positioned to cover the anchoring recess 25 formed in the outer circumference of the plug body 22.

As shown in FIG. 3, the connector plug 20 further includes along its axial line a center contact 21 fitted therein through an insulating sleeve, while the connector receptacle 10 includes along its axial line a center contact 11 fitted therein through an insulating sleeve. The socket 12 is formed with a plurality of slits 14 circumferentially spaced and extending in the axial direction and has a spring ring 15 thereon for increasing the springy force of the socket 12.

With this arrangement, the connector plug 20 is held with the coupling 23 grasped by one hand of an operator and is then inserted into the receptacle 10 (FIG. 4*a*), the stopper 13 of the connector receptacle 10 rides on the outer circumference of the plug body 22 and the forward end of the slide ring 24 is urged rearward against the force of the spring 26 by the stopper 13 of the connector receptacle 10. In this state, the contact 11 is fitted in the contact 21 to establish the electrical connection between them.

By further inserting the connector plug 20 into the connector receptacle 10, the slide ring 24 is retracted toward the cable holding portion 27 as shown in FIG. 4*b* and the stopper 13 is then engaged in the exposed anchoring recess 25 to reduce the outer diameter of the socket 12 as shown in FIG. 4*c*. At the same time, the stopper 13 disengages from the forward end of the slide ring 24 so that the slide ring 24 returns to its original position with the aid of the force of the spring 26, with the result that the slide ring 24 covers the stopper 13 to prevent it from removing from the anchoring recess 25. The electrical connection and locking of the connector are completed in this manner.

In disconnecting the connector, the connector plug 20 is pulled away from the connector receptacle 10 with the coupling 23 grasped by one hand of the operator so that the slide ring 24 is retracted by the latch portion 231 of the coupling 23 engaging the anchoring portion 241 toward the cable holding portion 27 against the spring force of the spring 26 to expose the anchoring recess 25. By further pulling the connector plug 20 from the connector receptacle 10, the stopper 13 is removed from the anchoring recess 25 to release the lock and disconnect the electrical connection between the contacts 11 and 21.

The push-on connector of the prior art described above has the advantage in that only the operation of the coupling 23 can perform the electrical connection and disconnection and the locking between the connector plug 20 and the connector receptacle 10. On the other hand, however, it involves a following problem in use.

In inserting the connector plug 20 into the connector receptacle 10, at the moment when the stopper 13 of the connector receptacle 10 has just abutted against the forward end of the slide ring 24 (FIG. 4*a* or 4*b*), the abutment "feeling" is often mistaken for a completion of the locking of the connector by the operator. In this case, therefore, the connector is then used for the inherent purpose without further insertion of the slide ring 24 or without locking the connector plug 20 and the connector receptacle 10.

If such a connector which is not completely locked and is used in an environment subjected to relatively violent vibrations such as a vehicle, the connector plug 20 tends to be dislodged from the connector receptacle 10 in use to cut the signal line associated therewith suddenly. In the push-in connector of the prior art, therefore, it is impossible to confirm in a reliable and easy manner whether the connector plug and the connector receptacle are completely locked or not.

SUMMARY OF THE INVENTION

It is an object of the invention to provide an electrical connector whose contacts do not contact each other until they have been completely locked, thereby preventing the connector from being used in the incompletely locked state.

In order to accomplish this object, in an electrical connector including a connector receptacle and a connector plug to be fitted each other, said connector receptacle having a cylindrical socket provided at the forward end with a stopper radially inwardly extending and formed with axially extending slits and a contact for the connector receptacle, and said connector plug having a plug body formed in the outer circumference with an anchoring recess to be fitted with said stopper, a coupling arranged on the plug body to be able to retract rearward, a slide ring arranged axially movably between the plug body and the coupling and forwardly urged by a spring arranged between the slide ring and the plug body to cover the anchoring recess by the forward end of the slide ring, and a contact for the connector plug to contact said contact for the connector receptacle electrically, whereby when the connector plug is inserted into the connector receptacle with the coupling grasped by an operator, the slide ring is urged rearward by the stopper to permit the stopper to be fitted into the anchoring recess exposed by the retraction of the slide ring, the fitting of the stopper into the anchoring recess reducing the outer diameter of the socket to disengage the slide ring from the socket so that the slide ring is returned by the action of the spring to the position covering the anchoring recess, according to the invention the distance between the forward ends of the contacts for the connector receptacle and the connector plug is more than the distance between the forward ends of the stopper and the slide ring but less than the distance between the stopper and the anchoring recess, whereby the contacts do not electrically contact each other at the moment when the stopper has abutted against the forward end of the slide ring, while the contacts electrically contact each other when the stopper has fitted in the anchoring recess by further insertion of the connector plug into the connector receptacle.

With this arrangement, at the moment when the stopper has abutted against the forward end of the slide ring on the way of insertion of the connector plug into the connector receptacle, the contacts do not contact each other. By further inserting the connector plug into the connector receptacle, they arrive in the completely locked state in that the stopper engages in the anchoring recess and the contacts sufficiently, electrically contact each other.

Therefore, there is no risk of the mere abutment of the stopper against the slide ring being mistaken for complete lock of the connector. Consequently, the connector according to the invention can be prevented from being used under the incompletely locked condition.

The invention will be more fully understood by referring to the following detailed specification and claims taken in connection with the appended drawings.

DESCRIPTION OF THE PREFERRED EMBODIMENTS

Figure 1:
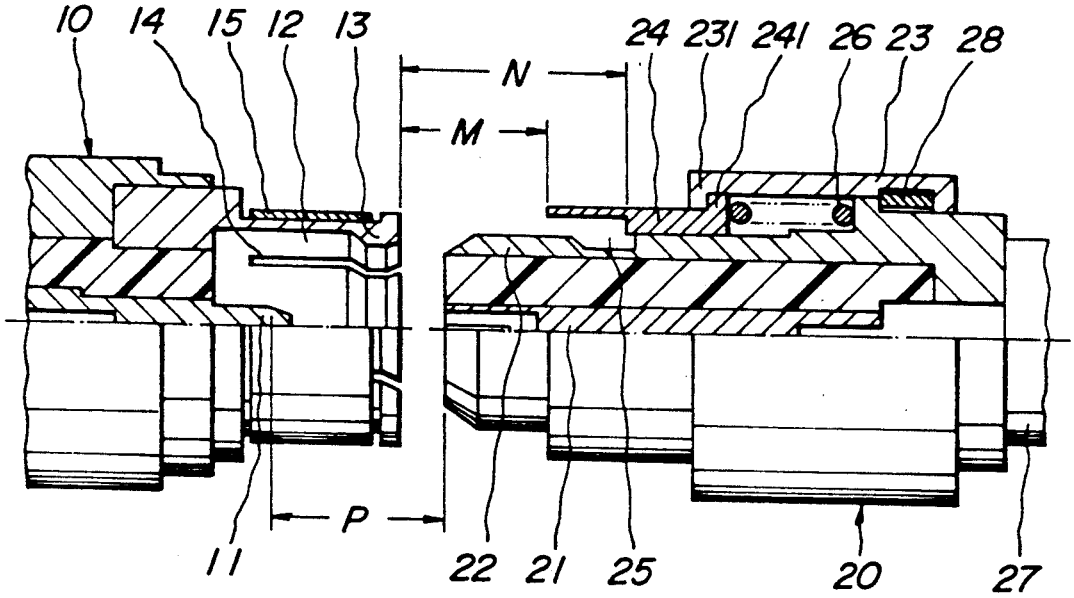
FIG. 1 is a partially sectional side view of an electrical connector according to the invention.

The electrical connector according to the invention is so constructed that the connector does not function until it has been completely locked. Referring to FIG. 1 and FIGS. 2*a* to 2*c* wherein like components are designated by the same reference numerals as those used in FIG. 3 and FIGS. 4*a* to 4*c*, when the stopper 13 of a connector receptacle 10 has abutted against the forward end of the slide ring 24 of a connector plug 20, contacts 11 and 21 of the connector receptacle 10 and the connector plug 20 have not contacted each other yet, but these contacts 11 and 21 sufficiently contact each other only after the the stopper 13 has been fitted in the anchoring recess 25 by sufficiently urging the slide ring 24 rearward by the stopper 13 of the connector receptacle 10.

In more practice, a distance P between the forward ends of the contacts 11 and 21 of the connector receptacle 10 and the connector plug 20 is longer than a distance M between the forward ends of the stopper 13 and the slide ring 24 but shorter than a distance N between the stopper 13 and the anchoring recess 25. In this case, the distance P is the actual distance between the contacts 11 and 21 plus the axial distance of the chamfered portion at the forward end of the contact 11 because this portion does not contact the mating contact 21.

In other words, the connector according to the invention is different in the following features from the connector of the prior art. The invention can be accomplished by combination of all or part of the following features (1) to (4).

(1) The forward end of the slide ring 24 is arranged nearer to the connector receptacle 10.

(2) The stopper 13 is arranged nearer to the connector plug 20.

(3) The forward end of the contact 21 for the connector plug is retracted relative to the connector receptacle 10.

(4) The forward end of the contact 11 for the connector receptacle 10 is retracted relative to the connector plug 20.

In practice, it should be considered that an effective fitted length of the contacts 11 and 21 is insured in order to obtain the complete electrical connection as a connector. In the case of the pin type contacts as shown in FIG. 1, it is preferable to bring the contacts 11 and 21 into contact with each other at least over a distance of 1.5 times the diameter of the contacts.

With this arrangement, at the moment when the stopper 13 has abutted against the forward end of the slide ring 24 on the way of insertion of the connector plug 20 into the connector receptacle 10, the contact 11 does not contact the contact 21 yet. By further inserting the connector plug 20 into the connector receptacle 10, they arrive in the completely locked state shown in FIG. 2*c* through the transitional condition shown in FIG. 2*b*. In the state shown in FIG. 2*c*, the contacts 11 and 21 sufficiently electrically contact each other.

Figure 2A:
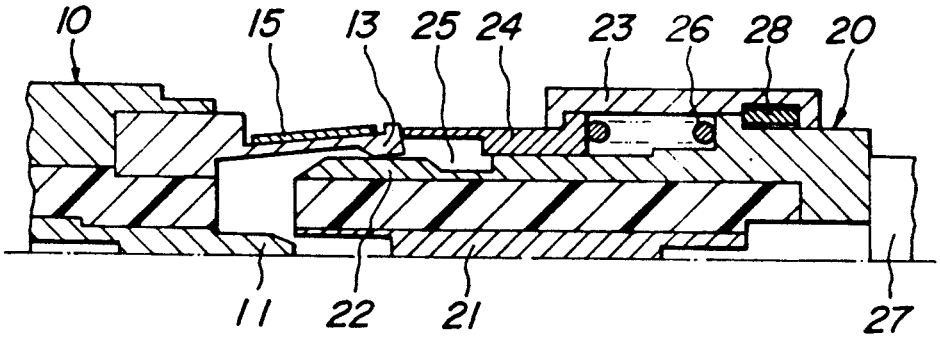
FIGS. 2*a*, 2*b* and 2*c* are partially sectional side views for explaining successive operations of the slide ring of the connector shown in FIG. 1.
Figure 2B:
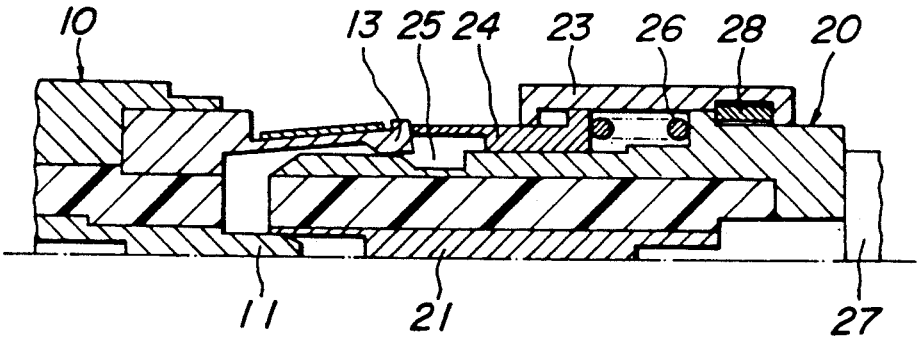

In the transitional state shown in FIG. 2*b*, the contacts 11 and 21 also electrically contact each other. However, even if the contacts 11 and 21 contact each other in the transitional state, it is unobjectionable because the mistaking of the mere abutment for the complete lock occurs at the moment of abutment of the stopper 13 against the slide ring 24 as shown in FIG. 1*a* and the distance in the transitional state is very short as shown in FIG. 2*b*.

While the invention has been explained applied to a coaxial connector, it is also applicable to other connectors having electrical contacts which are slidable in fitting directions, such as pin-socket type, relief type, tuning fork type connectors and their combinations. Moreover, the invention is applicable to a connector having contact pairs. In this case, the effect of the invention can be obtained by providing the relation between the contacts described above only to one pair of contacts.

The small type coaxial connector shown in FIG. 1 will be explained in more detail with respect to its dimensions and the like.

The connector receptacle 10 includes a cylindrical socket 12 formed with six slits 14 extending in its axial directions and having an inner diameter of about 4 mm. This socket 12 is electrically conductive and forms an outer contact for the coaxial connector. The socket 12 has the center contact 11 in the form of a pin having a diameter of about 1 mm. The center contact 11 has a chamfered forward end whose distal end is positioned approximately 5 mm retracted from the forward end of the socket 12. The socket 12 is formed at its forward end with the stopper 13 which is thicker than the remaining portion to reduce its inner diameter by about 0.5 mm.

The connector plug 20 has a plug body 22 of a 4 mm diameter and the center contact 21 positioned on the center line of the plug body 22 and adapted to be fitted with the center contact 11 of the connector receptacle 10. The plug body 22 is electrically conductive to form an outer contact for the coaxial connector. The annular slide ring 24 is axially reciprocatively slidably provided on the plug body 22 and urged toward the connector receptacle 10 by a coil spring 26.

The forward end of the slide ring 24 is positioned about 5 mm retracted from the forward end of the plug body 22. In inserting the forward end of the plug body 22 into the socket 12, at the moment when the forward end of the stopper 13 has abutted against the forward end of the slide ring 24 as shown in FIG. 2*a*, axial positions of the forward ends of the center contacts 11 and 21 of the connector receptacle 10 and the connector plug 20 are substantially coincident with each other. However, these center contacts do not electrically contact each other at this moment because the forward end of the center contact 11 of the connector receptacle 10 is chamfered.

Figure 2C:
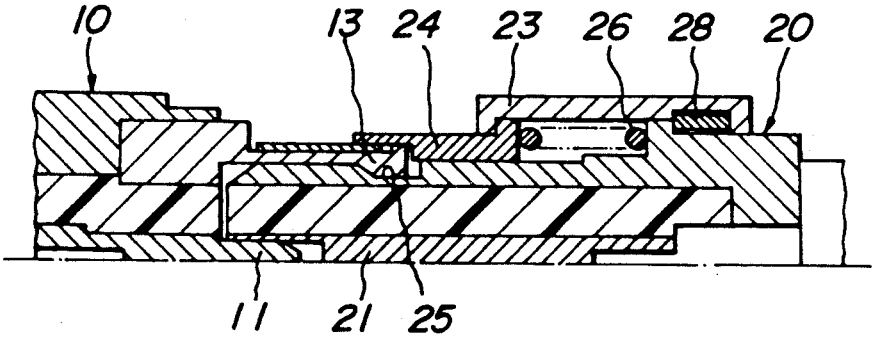
Figure 3:
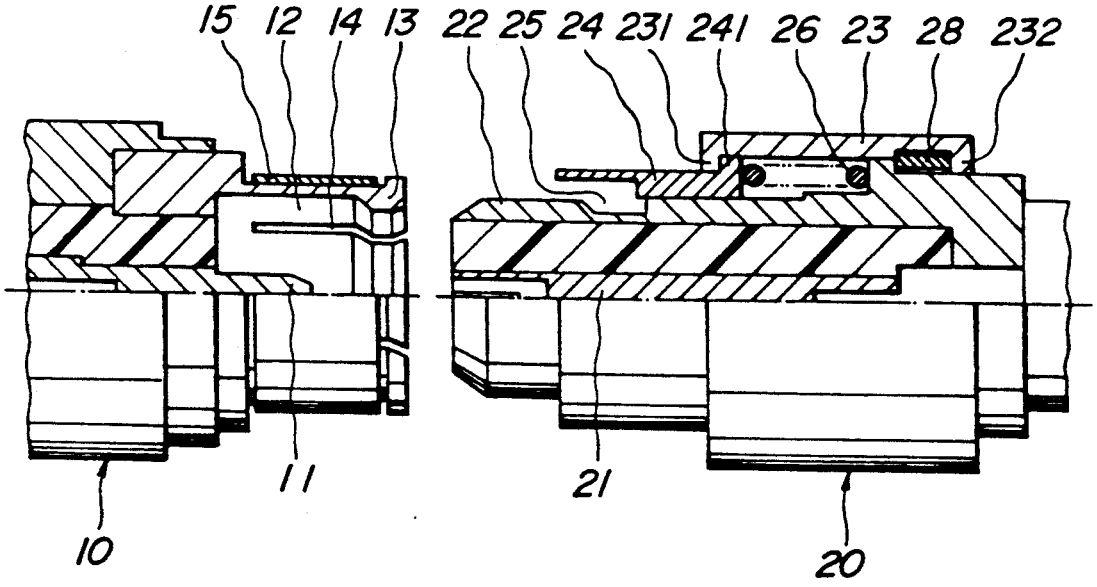
FIG. 3 PRIOR ART
FIG. 3 is a partially sectional side view of an electrical connector of the prior art.
Figure 4A:
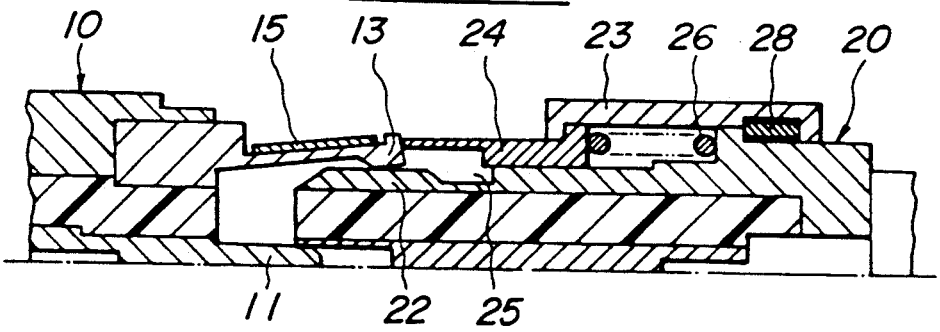
FIG 4a PRIOR ART
FIGS. 4*a*, 4*b* and 4*c* are partially sectional side views for explaining successive operations of the slide ring of the prior art connector shown in FIG. 3.
Figure 4B:
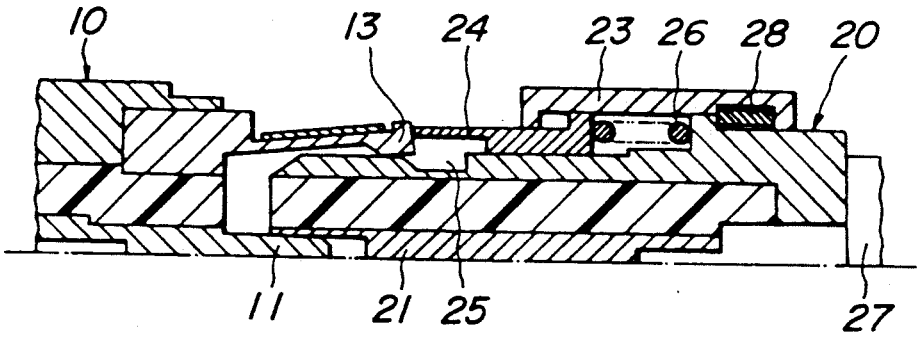
FIG 4b PRIOR ART
Figure 4C:
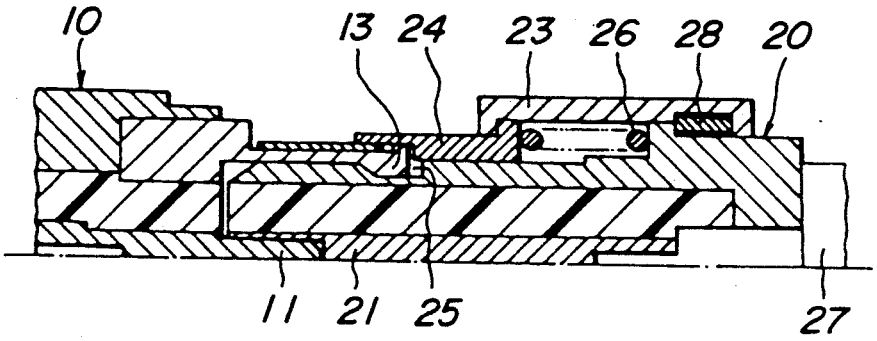
FIG 4c PRIOR ART

In this embodiment, by further inserting the connector plug 11 into the connector receptacle 10 by 2.5 mm deeper from the state shown in FIG. 2*a*, the stopper 13 is fitted in the anchoring recess 25 (the state in FIG. 2*c*). By determining the position of the anchoring recess 25 in this manner, the effective fitted length of the center contacts 11 and 21 is assured to be more than 2 mm. This value of the effective fitted length is sufficient for the coaxial connector.

With the connector according to the invention, there is no risk of the mere abutment of members of the connector being mistaken for complete lock of the connector. Even if the incompletely locked connector is used, the contacts are not conductive with each other in such an incompletely locked condition of the connector, so that any signals are not transmitted and an instrument incorporating the connector therein is not normally operated. Therefore, the incompletely locked connector is easily found before the instrument including such a connector is formally used. Accordingly, the connector according to the invention can be prevented from being used under the incompletely locked condition and hence there is no risk of the connector disconnecting to suddenly cut signals in use due to vibrations or the like.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector including a connector receptacle and a connector plug to be fitted with each other, said connector receptacle having a cylindrical socket provided at the forward end with a stopper radially inwardly extending and formed with axially extending slits and a contact for the connector receptacle, and said connector plug having a plug body formed in the outer circumference with an anchoring recess to be fitted with said stopper, a coupling arranged on the plug body to be able to retract rearward, a slide ring arranged axially movably between the plug body and the coupling and forwardly urged by a spring arranged between the slide ring and the plug body to cover the anchoring recess by the forward end of the slide ring, and a contact for the connector plug to contact said contact for the connector receptacle electrically, whereby when the connector plug is inserted into the connector receptacle with the coupling grasped by an operator, the slide ring is urged rearwards by the stopper to permit the stopper to be fitted into the anchoring recess exposed by the retraction of the slide ring, the fitting of the stopper into the anchoring recess reducing the outer diameter of the socket to disengage the slide ring from the socket so that the slide ring is returned by the action of the spring to the position covering the anchoring recess, wherein the distance between the forward ends of the contacts for the connector receptacle and the connector plug is more than the distance between the forward ends of the stopper and the slide ring but less than the distance between the stopper and the anchoring recess, whereby the contacts do not electrically contact each other at the moment when the stopper has abutted against the forward end of the slide ring, while the contacts electrically contact each other when the stopper has fitted in with the anchoring recess by further insertion of the connector plug into the connector receptacle.

2. The electrical connector as set forth in claim 1, wherein the contacts for the connector receptacle and the connector plug are pairs of contacts.

3. The electrical connector as set forth in claim 2, wherein only one pair of the contacts among the pairs of contacts are arranged in that the distance between the forward ends of the contacts for the connector receptacle and the connector plug is more than the distance between the forward ends of the stopper and the slide ring but less than the distance between the stopper and the anchoring recess, whereby the contacts do not electrically contact each other at the moment when the stopper has abutted against the forward end of the slide ring, while the contacts electrically contact each other when the stopper has fitted in the anchoring recess by further insertion of the connector plug into the connector receptacle.

4. The electrical connector as set forth in claim 1, wherein the contacts for the connector receptacle and the connector plug are pin-socket type contacts.

5. The electrical connector as set forth in claim 1, wherein the contact for the connector receptacle is a center contact provided along the center of the socket of the connector receptacle for a coaxial connector, and the contact for the connector plug is a center contact provided along the center of the plug body of the connector plug for the coaxial connector, and wherein the socket and the plug body are outer contacts to contact each other electrically for the coaxial connector.

* * * * *